United States Patent [19]

Rarick

[11] Patent Number: 5,036,806

[45] Date of Patent: Aug. 6, 1991

[54] REED VALVES FOR INTERNAL COMBUSTION ENGINES

[75] Inventor: Gregory S. Rarick, Bowers, Pa.

[73] Assignee: Performance Industries, Inc., Kempton, Pa.

[21] Appl. No.: 465,472

[22] Filed: Jan. 16, 1990

[51] Int. Cl.[5] ..... F02B 75/02

[52] U.S. Cl. ..... 123/65 V; 123/73 V; 137/855

[58] Field of Search ..... 137/855, 512.15, 512.1; 123/65 V, 73 A, 73 V

[56] References Cited

U.S. PATENT DOCUMENTS

| | | | |
|---|---|---|---|
| 157,791 | 12/1874 | Cameron . | |
| 919,036 | 4/1909 | Langer . | |
| 939,549 | 11/1909 | Reineking . | |
| 2,382,716 | 8/1945 | Herzmark . | |
| 2,689,552 | 9/1954 | Kiekhaefer . | |
| 3,690,304 | 9/1972 | Schneider et al. . | |
| 3,859,968 | 1/1975 | Stinebaugh . | |
| 3,896,847 | 7/1975 | Bauer et al. | 137/512.15 |
| 3,905,340 | 9/1975 | Boyesen . | |
| 3,905,341 | 9/1975 | Boyesen . | |
| 4,000,723 | 1/1977 | Boyesen . | |
| 4,051,820 | 10/1977 | Boyesen . | |
| 4,191,138 | 3/1980 | Jaulmes . | |
| 4,250,844 | 2/1981 | Tews . | |
| 4,324,097 | 4/1982 | Schmitt et al. . | |
| 4,331,118 | 5/1982 | Cullinan . | |
| 4,408,579 | 10/1983 | Kusche . | |
| 4,643,139 | 2/1987 | Hargreaves . | |
| 4,696,263 | 9/1987 | Boyesen . | |
| 4,712,520 | 12/1987 | Pasquin . | |

FOREIGN PATENT DOCUMENTS 55-5476 1/1980 Japan .

OTHER PUBLICATIONS

"Boyesen RAD Valve—The Ultimate Reed Valve," *Dirt Wheels*, (Oct. 1988), p. 31.

*Primary Examiner*—David A. Okonsky
*Attorney, Agent, or Firm*—David J. Johns

[57] ABSTRACT

The present invention provides an improved single stage or multiple stage reed valve for use in an air intake of an internal combustion engine. The multiple stage reed valve of the preferred embodiment includes a relatively stiff first stage reed member having ports therein, a relatively flexible second stage reed member comprising multiple reed petals to control flow through the ports in the first stage reed, and means to join each reed petals to an adjacent reed petal to cause the reed petals to move substantially in unison with one another. The present invention provides a reed valve with increased life and which is resistant to material fatigue even under conditions of uneven flow through the air intake.

31 Claims, 3 Drawing Sheets

FIG. 1
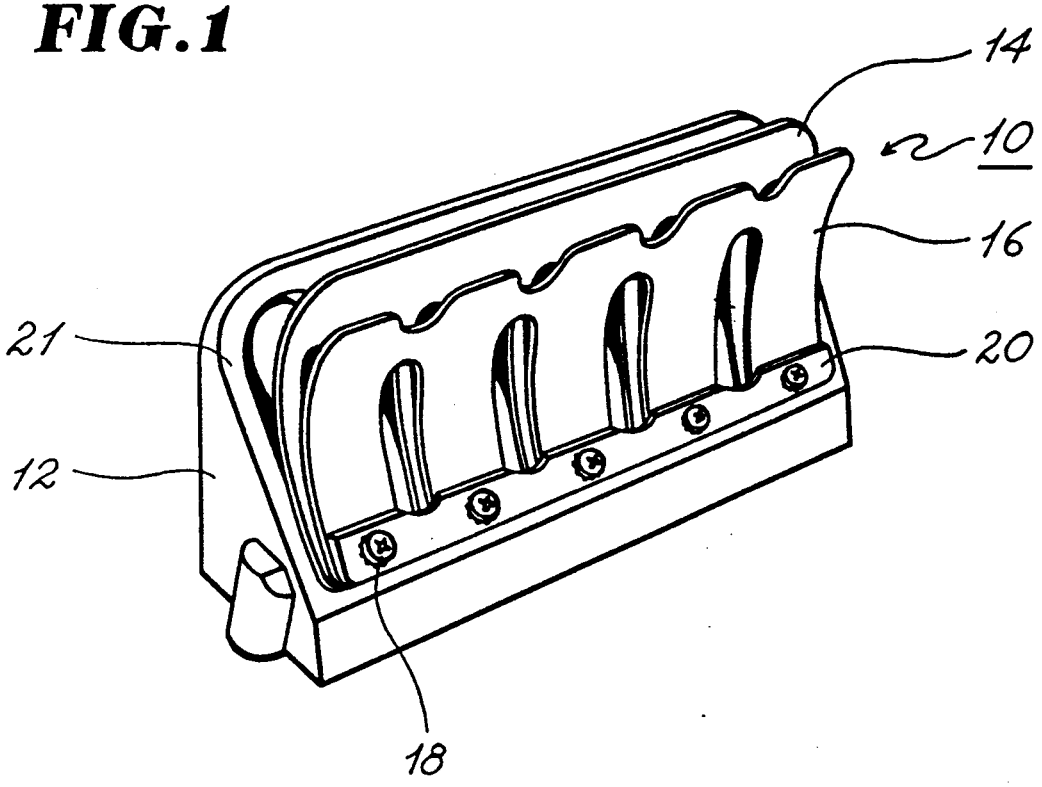
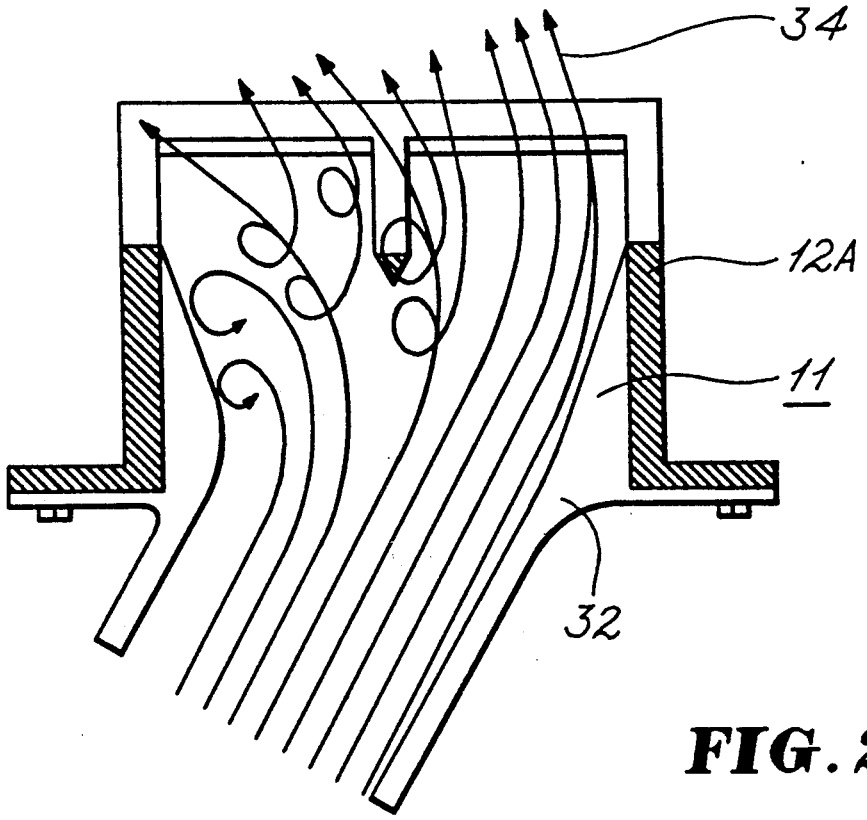
FIG. 2

REED VALVES FOR INTERNAL COMBUSTION ENGINES

BACKGROUND OF THE INVENTION

1. Field of the Invention

The present invention relates to reed valves for controlling air intake into internal combustion engines, and, more particularly, to an improved design for single and multiple stage reed valves for such engines.

2. Description of the Prior Art

Reed valves are presently widely employed in internal combustion engines to control air or air/fuel intake. In two-stroke cycle engines, such as disclosed in U.S. Pat. Nos. 3,905,340, 3,905,341, and 4,051,820, such reed valves play an important role in supporting the improved operation of the engine and the proper transfer of air and fuel from crankcase to combustion chamber. More recently, such reed valves also have been employed in four-stroke cycle engines to control air intake and improve engine performance.

In U.S. Pat. No. 3,905,340 it is shown that significant improvements in reed valve life and performance may be achieved by substituting a "vented" or multiple stage reed valve design in place of a conventional single stage reed. In the design disclosed in that patent, a relatively stiff primary reed is utilize having ports therein; this valve member is designed to be just flexible enough to open fully only under the greatly decreased internal engine pressure encountered at higher engine speeds (although it has been found that optimum performance is achieved if some opening of the primary reed valve occurs each engine cycle). A secondary reed member is then oriented over the ports in the primary reed, with a secondary reed petal sealing each of the primary reed ports. The secondary reed member provides fluid flow each engine cycle through the ports in the primary reed member. In order to allow such flow, the secondary reed members are far more flexible than the primary reed so that the secondary reed member opens farther than the primary reed during the pressure changes each engine cycle. The invention of the '340 patent improves engine performance in virtually all applications and, due to the reduced stresses inherent with this design, reed valve life is dramatically increased.

Although the multi-stage reed disclosed in U.S. Pat. No. 3,905,340 functions very well, it has been found that further improvements may be possible to that design. One problem that has been encountered is that many intake passages have uneven flow distribution through them which results in greater stress placed on certain petals of the secondary reed. As a result of the increased stresses placed on only some of the reed petals, the over-stressed petals will undergo material fatigue and break far more rapidly than less stressed reed petals. Further, with uneven flow distribution through the air intake, conventional or multi-staged reeds do not provide optimum air intake into the engine. One solution to this problem is addressed in U.S. Pat. No. 4,879,976 for an aeroform reed valve cage which modifies the intake passage upstream from the reed valves so to provide more even air flow through the reed valves. Even with this advance, additional improvements in reed valve performance and petal life are believed to be possible.

Accordingly, it is a primary object of the present invention to provide an improved reed valve which provides all the benefits of prior multi-stage reed valves while having improved flow characteristics, improved performance, and increased operating life.

It is a further object of the present invention to provide a reed valve with the above advantages which is straightforward in design and adds minimal weight, complexity, or expense to the engine or the air intake system.

SUMMARY OF THE INVENTION

The present invention provides an improved single or multiple stage reed valve which provides the performance advantages of a multi-stage reed valve while greatly reducing the likelihood of reed valve material fatigue and increasing reed valve performance and life.

In the preferred embodiment, the reed valve of the present invention comprises a primary reed valve member of sufficient rigidity so to provide minimal flex except under greatly reduced internal engine pressures and having ports therein; a secondary reed valve member of lesser rigidity so that it flexes under the pressure changes encountered with every change in engine pressure each cycle and including multiple reed petals, each corresponding to and covering one of the ports in the primary reed member; and means provided between the reed petals of the secondary reed member which cause each reed petal to move substantially in unison with its adjacent reed petals, so to minimize the stresses encountered by any given reed petal during operation.

The coordination of the reed petals is accomplished by providing a bridge between the petals, extending the common base between the petals so to join them, or a combination of both of these means. The present invention causes adjacent reed petals to move substantially simultaneously which greatly reduces the possibility of over extending any given reed petal due to uneven flow through the air intake. The benefits of the present invention may also be achieved by employing a member with joined reed petals as a single stage reed valve, providing improved performance and longer life for the single stage reed, and in a multiple stage reed valve by employing a primary valve member with joined reed petals.

The present invention increases substantially reed valve life, improves flow through the air intake of the engine, and improves engine performance. These benefits are achieved while adding no additional complexity or expense to the air intake system.

DESCRIPTION OF THE DRAWINGS

The operation of the present invention should become apparent from the following description when considered in conjunction with the accompanying drawings, in which:

FIG. 1 is a three-quarter isometric view of a reed valve cage including one embodiment of primary and secondary reed valves of the present invention;

FIG. 2 is a cross-sectional view of a conventional reed valve cage, with the arrows representing typical air flow characteristics;

DETAILED DESCRIPTION OF THE INVENTION

Figure 3A:
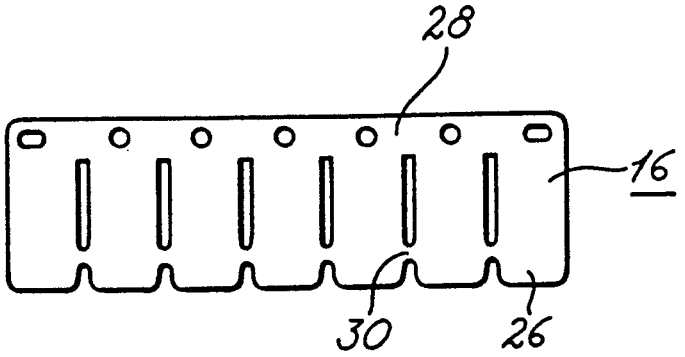
FIG. 3A is a plan view of a seven petal secondary reed valve member of one embodiment of the present invention.

The present invention provides an improved reed valve 10 which is less prone to fatigue and breakage and provides superior flow characteristics. As is explained below, the benefits of the present invention may be achieved by employing it in conjunction with a vented or multiple stage reed valve, or alone as a single stage reed valve.

FIG. 1 shows one embodiment of a multiple stage reed valve 10 of the present invention mounted on a conventional reed cage 12. The reed valve 10 comprises a primary or first stage valve member 14, and a secondary or second stage valve member 16. As is known, the reed valve is attached to a reed cage 12 by a plurality of screws or bolts 18 and a base plate 20 attached at one end of the reed valve 10. The reed cage 12 provides a valve seat 21 against which the reed valve member 14 seals.

Figure 3B:
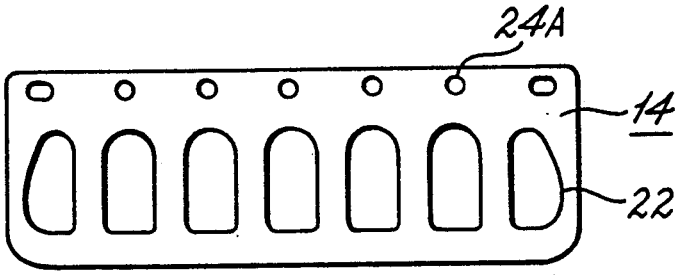
FIG. 3B is a plan view of a primary reed valve having seven ports and which would be used in conjunction with a seven petal secondary reed valve, such as is shown in FIG. 3A.

The structure of the valve members 14 and 16 is best seen by considering FIGS. 1, 3A and 3B. As is disclosed in U.S. Pat. No. 3,905,340, the primary reed member 14 includes one or more ports 22 therein and one or more openings 24A through which the valve member 14 may be attached to a reed cage 12 by bolts 18. The primary reed member may be constructed out of any thin resilient material which will minimize flexing at low pressure changes in an engine but will readily flex with the greatly reduced pressure encountered at higher engine speeds. It has been found that a woven glass fiber and epoxy laminate material of a thickness of approximately 0.015 to 0.030 inches, depending on the size of the reed petals and the particular engine size and configuration, functions quite well as a primary reed member 14. Common acceptable materials include those referred to as G-10, G-11, and G-13, as well as FR-4, FR-5, and FR-6. All these materials are readily available from any plastic source, such as Westinghouse Electric Corporation, Micarta Division.

The secondary reed member 16 comprises multiple reed petals 26, one for each of the ports 22 in the primary reed member 14, joined by a base 28. Each of the reed petals 26 is designed to cover and seal a corresponding port 22 in the primary reed member 14. Openings 24B for attachment of the valve member 16 to the reed cage 12 are also provided, corresponding to the openings 24B in the primary reed valve 14. In order to avoid premature fatigue of over-stressed reed petals 26, each reed petal 26 is joined to an adjacent reed petal by one or more bridges 30. The purpose of the bridges 30 is to join the petals 26 together so that all the petal move substantially as one unit, even if some reed petals 26 are receiving uneven pressure. It has been found that a woven glass fiber and epoxy laminate material of a thickness of approximately 0.010 to 0.021 inches, again depending on the size of the reed petals and the engine size and characteristics, provides a suitable secondary reed member 16. The bridges 30 may be added by any suitable means, including as a separate laminate affixed to the reed petals. Preferably the bridges 30 are formed as an integral part of the secondary reed member 16 by being added to a cutting die for the reed member 16 as a whole. In this manner the bridges 30 are cut out in one step along with the entire secondary reed valve member 16 and the present invention adds no additional expense or material cost to the basic reed valve design.

By causing the reed petals 26 to move in unison, at least two important functions are accomplished. First, stresses on the reed petals 26 are more evenly distributed and this greatly reduces the material fatigue often encountered with uneven flow through the reed valves 10. Second, the tying together of the secondary reed valve member 16 is believed to promote improved flow through the reed valve 10 as a whole, thus improving air intake and engine performance. Although the term "air intake" is used throughout this application, it should be understood that the intake of either air or air and fuel may be encompassed by this term; the present invention functions equally well in a carbureted or fuel injected engine.

FIG. 2 is a representation of the flow conditions often encountered an air intake 11 upstream from a typical reed cage assembly 12A. Due to the construction of a typical throat 32 leading up to a reed cage assembly 12A, flow distribution through the reed valves, as represented by arrows 34, is uneven. In the configuration of FIG. 2, the primary flow through the secondary reed petals will be on the right side of the reed cage 12A, with greatly reduced flow through the secondary reed petals on the left side of the reed cage 12A. Operation of an engine with these intake characteristics will result in the premature fatigue and failure of the secondary reed petals on the right side of the reed cage 12A. Fortunately with reed valves constructed of glass laminate, as discussed above, reed valve failure no longer results in the serious engine damage as was the case with metal reed valves; however, premature reed failure remains a substantial problem requiring increased maintenance and expense and may have serious repercussions if it occurs during periods of high engine demand, such as in racing or hill climbing.

Figure 4:
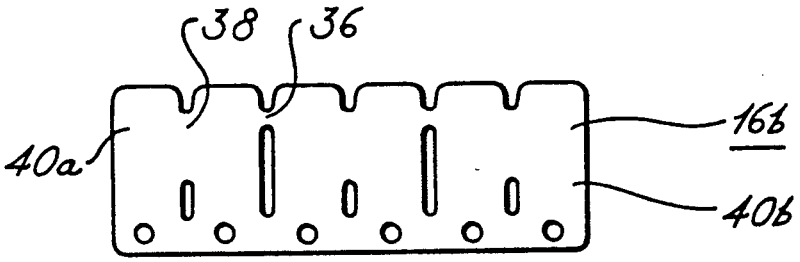
FIG. 4 is a plan view of a five petal secondary reed valve member of the present invention incorporating modified bridges.

FIGS. 4 through 9 show six alternative configurations for reed valve member 12 incorporating the present invention. FIG. 4 is a six petal secondary reed valve member **16*b* employing alternating small bridges 36 and large bridges 38. This design provides greater structural integrity for the reed valve member 16*b* as a whole. Additionally, extended bridges 38 on certain petals (such as the two outer most petals 40*a* and 40*b***) which may encounter greater stress further reduces the likelihood of breakage.

Figure 5:
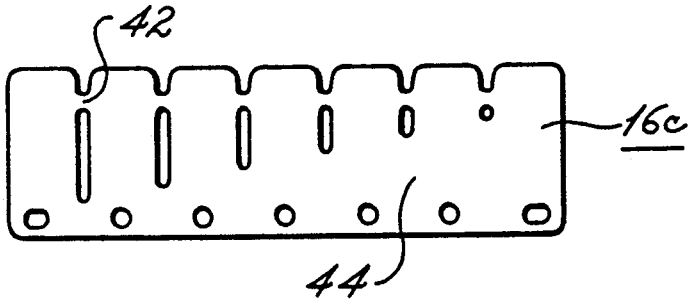
FIG. 5 is a plan view of a seven petal reed valve member of the present invention incorporating a modified base.

FIG. 5 is a seven petal secondary reed valve member **16*c* having uniform bridges 42 but employing a modified base 44. In this configuration the reed valve member 16c is reinforced with an extended base 42 favoring its right side. This reed valve member 16c would be employed in an air inlet which has very heavy flow on one side but reduced flow on the other side, such as shown in FIG. 2**.

Figure 6:
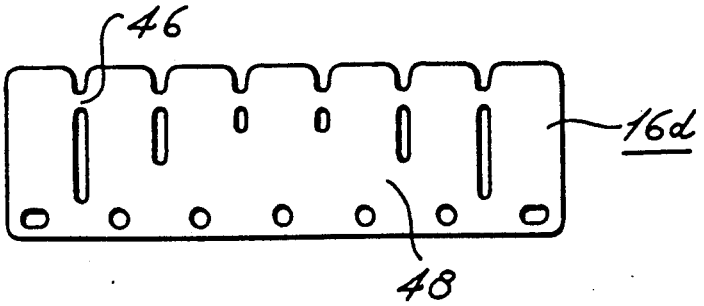
FIG. 6 is a plan view of a seven petal reed valve member of the present invention incorporating another modified base.

FIG. 6 is a seven petal secondary reed valve member 16d again having uniform bridges 46 but employing another form of modified base 48. In this configuration the reed valve member 16d is reinforced with an extended base 48 favoring the middle of the valve member 16d. This reed valve member 16d would be employed in an air inlet which has very heavy flow in the center of the inlet.

Figure 7:
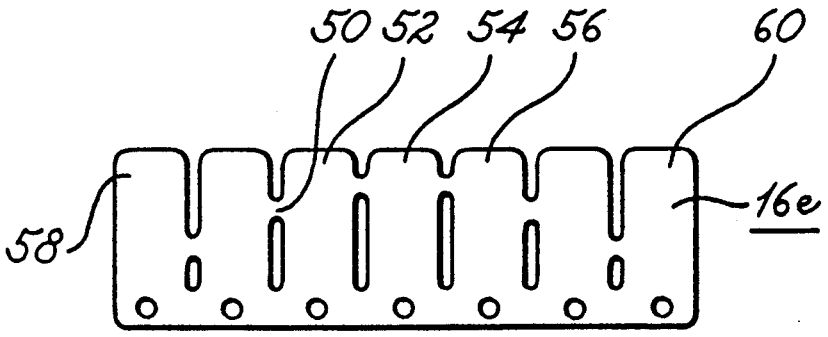
FIG. 7 is a plan view of a seven petal reed valve member of the present invention incorporating modified bridge placement.

The seven petal secondary reed valve member 16e of FIG. 7 is another solution to this same flow condition. In this configuration the reed valve member 16e is selectively reinforced by placing bridges 50 in different positions relative to the ends of the reed petals. The reed valve 16e shown provides greatest rigidity between the reed petals 52, 54, 56 in the center, and lesser rigidity for the outer most reed petals 58, 60.

Figure 8:
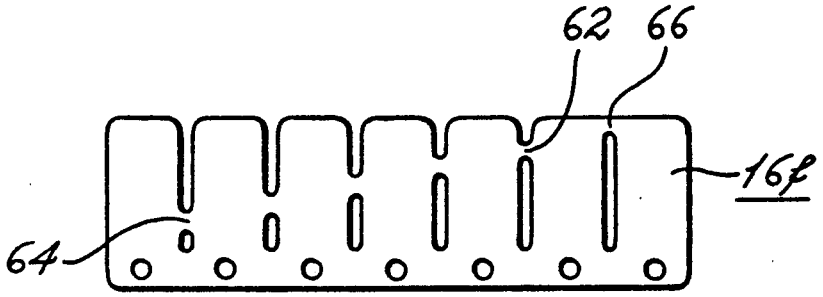
FIG. 8 is a plan view of a seven petal reed valve member of the present invention incorporating another modified bridge placement.

Similarly, through selective bridge 62 placement on the secondary reed valve member 16f of FIG. 8, the flow conditions solved by the reed valve member 16c of FIG. 5 may alternatively be solved. In this embodiment of the present invention the bridges 62 are positioned from low 64 to high 66 to provide the necessary degree of rigidity. The reed valve 16f of this configuration would be employed in an air intake where the greatest flow would be on the right hand side and the least flow would be on the left hand side.

Figure 9:
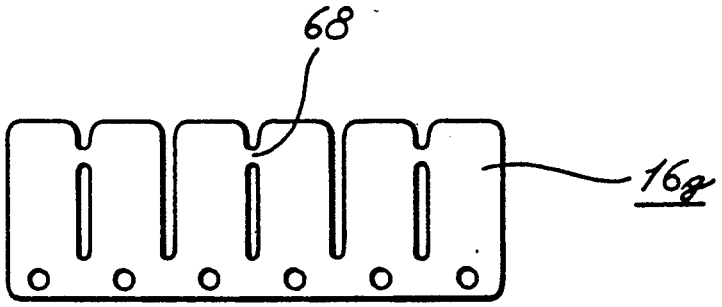
FIG. 9 is a plan view of a six petal reed valve member of the present invention incorporating paired reed petals and alternating bridge placement.

It may be desirable to provide a secondary reed valve member 16g which includes the benefits of the present invention while maintaining some degree of reed petal independence across the reed valve member 16g. As is shown in FIG. 9, bridges 68 may be provided selectively between certain reed petals to reinforce only where necessary. Where flow is essentially uniform across the air intake, this configuration provides the benefits of the present invention while providing minimal restriction of secondary reed petal movement. This may be particularly beneficial where extremely low end response is desired and reed petal movement must be as unrestricted as possible.

It should be appreciated that the benefits of the present invention may also be achieved by employing joined reed valves as the sole reed valve member in single stage reed valves. In order to decrease fatigue and premature breakage in single stage reed valves, it is common today to employ an unsegmented, single sheet, reed valve member which covers multiple valve seats in a reed cage. The theory supporting this configuration is that the unsegmented valve member is less prone to breakage than individual reed petals. Unfortunately, in order to create a single unsegmented valve member of sufficient flexibility, a relatively thin laminated material must be utilized. Invariably when this thinner material is placed under the normal stresses of the engine, including the substantial striking force between the single reed valve and the reed cage, relatively rapid delamination begins to occur—ironically causing premature aging and fatigue of the reed valve member.

By employing a reed valve member 16 utilizing joined reed petals, such as those shown in FIGS. 4 through 9, as the single stage reed valve the problem of premature delamination may be greatly reduced. The segmented but joined valve member of the present invention provides sufficient flexibility that thicker materials may be used to achieve the same response possible with the all-in-one design discussed above. It has been found that the thicker material is far less prone to premature delamination in light of its greater integrity and its higher quantity glass and epoxy composition. Additionally, flow through the reed valve member of the present invention is less restricted and, accordingly, promotes improved engine response. Thus, two important benefits are believed to be achieved by employing the present invention as a single stage reed valve: improved air intake flow, and greatly reduced reed valve fatigue.

Figure 10:
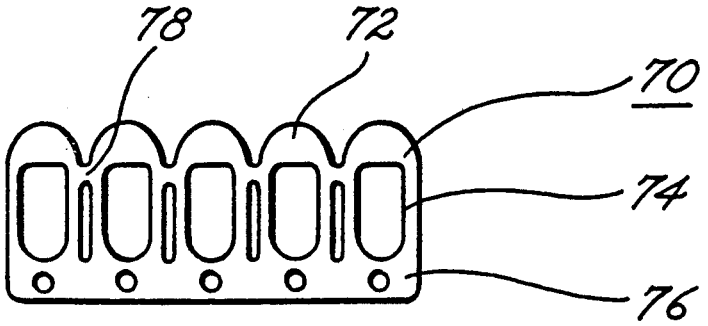
FIG. 10 is a plan view of a five petal primary reed valve member of the present invention incorporating ported reed petals joined by bridges.

With respect to multiple stage reed valves, it should be appreciated that the teachings of the present invention may be equally applied to the primary or first stage reed valve member. Shown in FIG. 10 is another embodiment of the present invention employing a segmented first stage reed valve member 70. The reed valve member comprises first stage reed petals 72, each with a port 74 to permit fluid flow therethrough, a base 76, and means to join the petals, such as bridges 78 shown. As is true with the joined secondary reed petals 16, this configuration permits use of thicker and stronger reed material while still providing the desired degree of flexibility. Again, the placement of the bridges 78 or extension of the base 76 may be altered, such as shown with respect to the secondary reed petals in FIGS. 4 through 9, to provide the desired flow characteristics. The joined primary reed member 70 may be employed with any form of secondary reed valve member, including an unsegmented valve member, a segmented valve member, or a secondary valve member of joined petals of the present invention.

While particular embodiments of the present invention have been illustrated and described herein, it should be apparent that changes and modifications may be incorporated and embodied therein within the scope of the following claims.

What is claimed is:

1. In an internal combustion engine having an air intake means, fluid flow through the air intake being controlled by flexible multiple stage reed valves, the improvement which comprises:

said multiple stage reed valves including a first stage reed member and multiple second stage reed petals;

said first stage reed member covering a valve seat within said air intake means and being sufficiently flexible to open the valve seat under the influence of decrease in pressure in the engine incident to high speed engine operation but being sufficiently rigid to open minimally under the influence of decrease in pressure in the intake chamber incident to low speed engine operation, said first stage reed member having therein multiple ports to permit fluid flow therethrough;

each said second stage reed petal being adapted to cover one of the ports in the first stage reed member and to restrict fluid flow through the reed valves during periods of no fluid intake into the engine, said second stage reed petals being sufficiently flexible to uncover the ports in the first stage reed member under the influence of decrease in pressure in the intake chamber incident to engine operation at high and low engine speeds;

each said second stage reed petal being joined to an adjacent reed petal so to cause each reed petal to move substantially simultaneously with its adjacent reed petals.

2. The engine of claim 1 wherein each of the second stage reed petals is additionally joined to its adjacent reed petals by a common base, creating a second stage reed member.

3. The engine of claim 2 wherein the second stage reed member is attached to the engine by means of said base.

4. The engine of claim 3 wherein the second stag reed member is attached to said engine by at least one bolt which passes through the base of said second stage reed member and attaches to a reed cage, said reed cage attaching to the engine.

5. The engine of claim 4 wherein said first stage reed member and said second stage reed member attach to said reed cage by the same bolt.

6. The engine of claim 1 wherein said reed petals are joined by means of a bridge.

7. The engine of claim 6 wherein the bridge and the reed petals comprise identical material.

8. The reed valve of claim 6 wherein each bridge is oriented in the same position relative to the ends of each of the reed petals.

9. The reed valve of claim 6 wherein each bridge is oriented in a position relative to the ends of each of the reed petals so to maximize fluid flow through the reed valve for a given engine's air intake flow characteristics.

10. The reed valve of claim 6 wherein each bridge is oriented in a position relative to the ends of each of the reed petals so to minimize the stress placed on any given reed petal for a given engine's air intake flow characteristics.

11. The reed valve of claim 1 wherein said first stage valve member includes multiple segmented first stage reed petals and means to join the first stage reed petals so that the petals move substantially in unison with one another.

12. In a multiple stage reed valve for controlling air intake into an internal combustion engine, each stage having a different degree of flexibility, and including a first stage reed member of greatest stiffness and having therein multiple ports and a second stage reed member of lesser stiffness and having multiple reed petals, each reed petal corresponding to one of the multiple ports in the first stage reed so to cover completely each such port and to restrict air flow through the reed valves during periods of no air intake into the engine, the improvement which comprises:

said second stage reed member having a base joining each of the reed petals at one end, said second stage reed member being anchored to said engine by means attaching to said base, and means to join a reed petal to an adjacent reed petal at a point spaced from said base to cause the joined reed petals to move substantially in unison.

13. The reed valve of claim 12 wherein the means to anchor said second stage reed member to said engine comprises at least one bolt which passes through the base of said second stage reed member and attached to a reed cage, said reed cage attaching to the engine.

14. The reed valve of claim 13 wherein said first stage reed member and said second stage reed member attach to said reed cage by the same bolt.

15. The reed valve of claim 12 wherein the means to join a reed petal to an adjacent reed petal so to cause the joined reed petals to move substantially in unison comprises a bridge between the adjacent reed petals.

16. The reed valve of claim 15 wherein said bridges are positioned intermediate the ends of said reed petals.

17. The reed valve of claim 15 wherein the bridge and the reed petals comprise identical material.

18. The reed valve of claim 15 wherein each bridge is oriented in the same position relative to the ends of each of the reed petals.

19. The reed valve of claim 12 wherein said first stage reed valve member is divided into individual first stage reed petals, and said first stage valve member includes means to join a first stage reed petal to an adjacent first stage reed petal so to cause the joined reed petals to move substantially in unison.

20. In an internal combustion engine having an air intake, the air flow through which is controlled by a reed valve, the improved reed valve which comprises:

multiple segmented reed petals, collectively controlling flow through a reed cage positioned within the air intake so that flow through the air intake occurs only upon a sufficient decrease in pressure within the engine; and means to join the reed petals so that the petals move substantially in unison with one another while maintaining separation of the petals from one another at least in part.

21. The apparatus of claim 20 wherein said means to join the reed petals so that the petals move substantially in unison with one another comprises a bridge between each reed petal and a reed petal adjacent to it.

22. The engine of claim 21 wherein the bridges and the reed petals comprise identical material.

23. The reed valve of claim 21 wherein each bridge is oriented in the same position relative to the ends of each of the reed petals.

24. The reed valve of claim 21 wherein said bridges are positioned intermediate the ends of said reed petals.

25. The reed valve of claim 20 wherein said reed valve is a multiple stage reed valve, including a first stage valve member having ports therein and a second stage valve member adapted to seal the openings in the first stage valve member.

26. The reed valve of claim 25 wherein said first stage valve member includes the multiple segmented reed petals and the means to join the reed petals so that the petals move substantially in unison with one another.

27. The reed valve of claim 25 wherein said second stage valve member includes the multiple segmented reed petals and the means to join the reed petals so that the petals move substantially in unison with one another.

28. The reed valve of claim 25 wherein said first stage valve member includes the multiple segmented reed petals and the means to join the reed petals so that the petals move substantially in unison with one another; and said second stage valve member includes the multiple segmented reed petals and the means to join the reed petals so that the petals move substantially in unison with one another.

29. In an internal combustion engine having an air intake means, fluid flow through the air intake being controlled by flexible multiple stage reed valves, the improvement which comprises:

said multiple stage reed valves including a first stage reed member and a second stage reed member;

said first stage reed member having multiple first stage reed petals, each covering a valve seat within said air intake means and being sufficiently flexible to open the valve seat under the influence of decrease in pressure in the engine incident to high speed engine operation but being sufficiently rigid to open minimally under the influence of decrease in pressure in the intake chamber incident to low speed engine operation, and each said first stage reed petal having therein a port to permit fluid flow therethrough;

said second stage reed member being adapted to cover the ports of each of the first stage reed petals and to restrict fluid flow through the reed valves during periods of no fluid intake into the engine, said second stage reed member being sufficiently flexible to uncover the openings in the first stage reed member under the influence of decrease in pressure in the intake chamber incident to engine operation at high and low engine speeds;

each said first stage reed petal including means to join each petal to an adjacent reed petal so to cause each reed petal to move substantially simultaneously with its adjacent reed petals;

said second stage valve member including multiple segmented reed petals and means to join each petal to an adjacent reed petal so to cause each reed petal to move substantially simultaneously with its adjacent reed petals, each said second stage reed petal adapted to cover a port in said first stage reed petal.

30. The reed valve of claim 29 wherein the means to join each said reed petal to an adjacent reed petal so to cause each reed petal to move substantially simultaneously with its adjacent reed petals comprises a bridge between adjacent reed petals.

31. In an internal combustion engine having an air intake means, fluid flow through the air intake being controlled by flexible multiple stage reed valves, the improvement which comprises:

said multiple stage reed valves including a first stage reed member and a second stage reed member;

said first stage reed member having multiple first stage reed petals, each covering a valve seat within said air intake means and being sufficiently flexible to open the valve seat under the influence of decrease in pressure in the engine incident to high speed engine operation but being sufficiently rigid to open minimally under the influence of decrease in pressure in the intake chamber incident to low speed engine operation, and each said first stage reed petal having therein a port to permit fluid flow therethrough;

said second stage reed member being adapted to cover the ports of each of the first stage reed petals and to restrict fluid flow through the reed valves during periods of no fluid intake into the engine, said second stage reed member being sufficiently flexible to uncover the openings in the first stage reed member under the influence of decrease in pressure in the intake chamber incident to engine operation at high and low engine speeds;

said first stage reed member including means to join a first stage reed petal to an adjacent reed petal so to cause each joined reed petal to move substantially simultaneously with its adjacent reed petal while maintaining separation of the petals from one another at least in part.

* * * * *